US009655482B2

(12) United States Patent
Michelson et al.

(10) Patent No.: US 9,655,482 B2
(45) Date of Patent: May 23, 2017

(54) CLEANING SCRUBBER FOR HOUSEHOLD SURFACES

(71) Applicant: Butler Home Products LLC, Marlborough, MA (US)

(72) Inventors: Robert Michelson, Wayland, MA (US); Michael Silverman, Westborough, MA (US); Robert Cavalcanti, Shrewsbury, MA (US)

(73) Assignee: Butler Home Products LLC, Hudson, MA (US)

( * ) Notice: Subject to any disclaimer, the term of this patent is extended or adjusted under 35 U.S.C. 154(b) by 382 days.

(21) Appl. No.: 14/196,831

(22) Filed: Mar. 4, 2014

(65) Prior Publication Data

US 2014/0251844 A1 Sep. 11, 2014

Related U.S. Application Data

(60) Provisional application No. 61/772,852, filed on Mar. 5, 2013.

(51) Int. Cl.

| | |
|---|---|
| ***A47K 11/10*** | (2006.01) |
| ***A47K 17/00*** | (2006.01) |
| ***A47L 13/10*** | (2006.01) |
| ***A47L 13/16*** | (2006.01) |

(52) U.S. Cl.

CPC ..... *A47K 11/10* (2013.01); *A47K 17/00* (2013.01); *A47L 13/10* (2013.01); *A47L 13/16* (2013.01)

(58) Field of Classification Search

CPC ..... A47K 11/10; A47L 13/10; A47L 13/16; A47L 13/44; A47L 13/46

See application file for complete search history.

(56) References Cited

U.S. PATENT DOCUMENTS

| | | | | |
|---|---|---|---|---|
| 2,610,347 | A * | 9/1952 | Kleiner | A47L 13/24 15/145 |
| 3,786,807 | A * | 1/1974 | Dubin | A61F 6/12 128/838 |
| 4,031,673 | A * | 6/1977 | Hagelberg | A47K 11/10 15/104.94 |
| 5,323,507 | A * | 6/1994 | Tosato | A47L 13/46 15/231 |
| 6,546,587 | B2 * | 4/2003 | Christiansen | A47L 13/24 15/147.2 |
| 6,611,986 | B1 * | 9/2003 | Seals | A47K 11/10 15/210.1 |
| 7,530,138 | B1 * | 5/2009 | Platt | A46B 9/005 15/147.1 |
| 7,603,739 | B2 * | 10/2009 | Minkler | A47L 13/16 15/145 |

(Continued)

*Primary Examiner* — Randall Chin

(74) *Attorney, Agent, or Firm* — McCarter & English, LLP

(57) ABSTRACT

A cleaning scrubber for cleaning household surfaces is described. The cleaning scrubber includes an elongated handle having a gripping portion at the proximal end and a means for removably attaching a cleaning disk at the distal end. The cleaning disk comprises a foam or sponge cleaning pad and means for attachment to the handle. The handle may include means for releasing the cleaning disk from the end of the handle without the need for the user to manually handle the cleaning disk. A caddy for storage of the cleaning scrubber and spare cleaning disks is also described.

8 Claims, 8 Drawing Sheets

(56) References Cited

U.S. PATENT DOCUMENTS

| | | | | |
|---|---|---|---|---|
| 7,900,287 | B2 * | 3/2011 | Wildauer | E03C 1/308 4/255.11 |
| 8,875,337 | B2 * | 11/2014 | Tacoma | A47K 7/028 15/145 |
| 2005/0204499 | A1 * | 9/2005 | Jackson | A46B 7/04 15/176.6 |
| 2006/0225237 | A1 * | 10/2006 | Gartland | A47K 11/10 15/210.1 |
| 2007/0192978 | A1 * | 8/2007 | Michelson | A47L 13/144 15/208 |

* cited by examiner

CLEANING SCRUBBER FOR HOUSEHOLD SURFACES

CROSS-REFERENCE TO RELATED APPLICATION

This application claims priority under 35 U.S.C. §119(e) to U.S. Provisional Application No. 61/772,852 filed on Mar. 5, 2013, the entire contents of which are incorporated herein by reference.

FIELD OF THE INVENTION

The present invention relates, in one aspect, to a scrubber for cleaning household surfaces, such as for example the inner surface of a toilet bowl, a sink, or a bathtub.

In another aspect, the present invention relates to a caddy for the cleaning device. The caddy includes a base and a container that may be attached to the base. The base includes a cup sized for holding a cleaning disk. The hollow container may be used to hold additional cleaning disks. A cover may be provided on the container to close the container.

SUMMARY OF THE INVENTION

The present invention is directed generally to a scrubber for cleaning household surfaces. In one embodiment, the cleaning scrubber has an elongated handle with a proximal gripping end and a distal end. The distal end of the handle includes a cleaning disk holder having means for attaching a disposable cleaning disk to the end of the handle. The cleaning disk comprises a pad having a cleaning surface on one side of the pad. On the side of the pad opposite the cleaning surface, attachment means are provided that are complementary to the attachment means on the distal end of the handle. The cleaning surface of the cleaning disk may be made of any appropriate material for cleaning household surfaces. In one embodiment, the cleaning disk is comprised of melamine foam. The cleaning disk may be attached to the distal end of the handle using, for example, Velcro, an adhesive, or a locking mechanism using snaps or slots. In some embodiments, the cleaning disk may have a backing plate fixedly attached to the pad on the side opposite the cleaning surface with the attachment means for the cleaning pad on or attached to the backing plate.

In one embodiment, means are provided for releasing the cleaning disk from the end of the handle. The cleaning disk holder is attached to a rod which extends within the handle to the proximal gripping end. At the proximal end of the rod, a trigger is attached to the rod and extends through the handle. The trigger is movable from a first distal position to a second proximal position. A biasing member, such as a coil spring, biases the rod, and the trigger, from the second position toward the first position. When the trigger is moved from the first position to the second position, the disk holder is withdrawn into a housing at the end of the handle and the housing provides a stop surface that forces the cleaning disk to be dislodged from the disk holder. When the trigger is released, the biasing member moves the trigger, rod and the disk holder back to the first position.

In another embodiment, a caddy is provided for the cleaning scrubber. The caddy has a base portion and an upper portion that is attachable to the base portion. The base includes a cup sized to receive a cleaning disk. The upper portion may be sized to hold spare cleaning disks. The caddy may be used to store the cleaning scrubber between uses.

DETAILED DESCRIPTION OF THE INVENTION

FIGS. 1-4 show side views of one embodiment of the cleaning scrubber of the present invention. The cleaning scrubber 10 is comprised of an elongated handle 12 having a circular shaped end portion 18 at the distal end. The handle may be made of any appropriate material. In one embodiment, the handle is made of a plastic. A grip 14 for holding the handle may be provided at the proximal end. The grip may be made of rubber or any other material that will aid in holding the handle.

Figure 6:
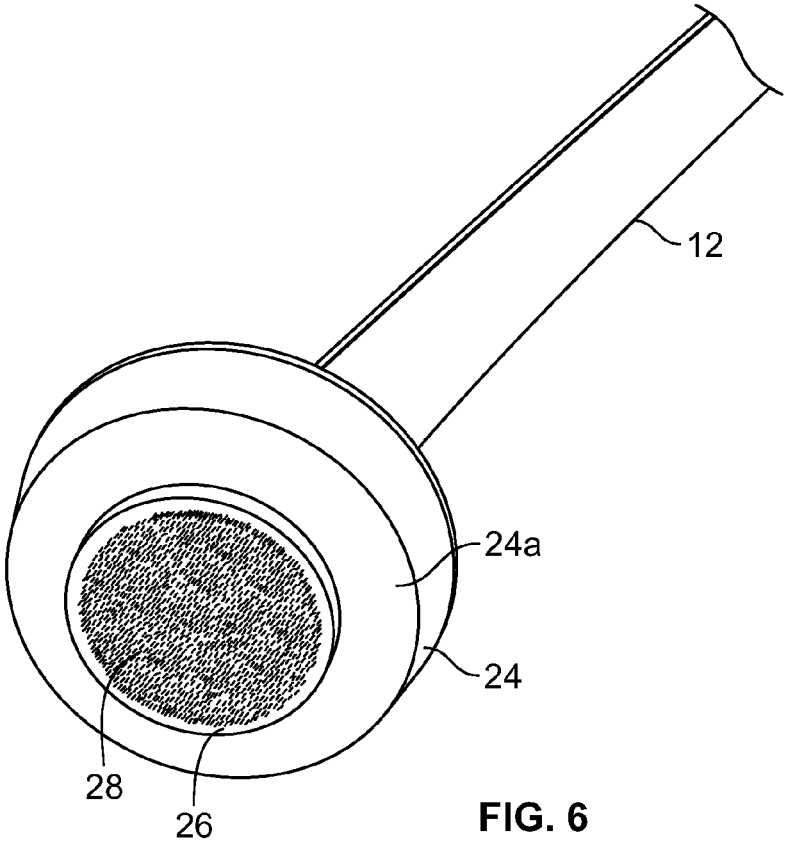
FIG. 6 shows one embodiment of the distal end of the handle of the cleaning scrubber without a cleaning disk attached.

A housing 24 is fixedly attached to the circular shaped end portion 18 of the handle 12. As shown in FIG. 6, the housing 24 has a hole in the center portion to allow the end of a disk holder 26 to protrude through the housing 24. As discussed in detail below, the disk holder 26 may be part of an assembly within the elongated handle 12 for removing a cleaning disk 21 without the need for the user to handle the cleaning disk 21 after use. Alternatively, the disk holder 26 may be fixedly attached to the end portion 18 or the housing 24, and the cleaning disk 21 may be manually removed from the disk holder 26 after use.

Figure 5:
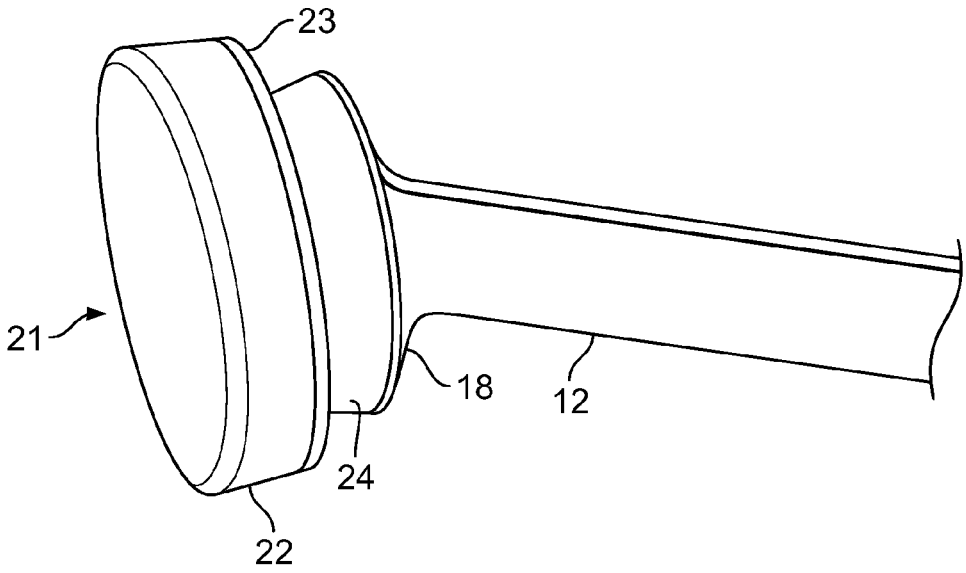
FIG. 5 shows the distal end of one embodiment of the handle of the cleaning scrubber with a cleaning disk attached.

As further shown in FIG. 6, attachment means 28 are provided on the surface of the disk holder 26 for holding a cleaning disk 21. As discussed further below, complementary means for attaching a cleaning disk 21 to the disk holder 26 may be provided on one side of the cleaning disk. In the embodiment shown in FIG. 6, the attachment means 28 on the disk holder are a Velcro type system wherein the surface of the disk holder 26 has a plurality of small hooks and/or loops. As shown in FIG. 5 and discussed further below, one side of the cleaning disk 21 has a material 23 with a plurality of hooks and/or loops that that can be attached to the hooks and/or loops on the disk holder. The invention is not limited in this regard, and any appropriate means for attaching the cleaning disk 21 to the disk holder 26 may be used. For example, adhesives may be used, or a snap or slot type of attachment mechanism may be used.

An embodiment of a cleaning disk 21 of the present invention is shown in FIG. 5 attached to the disk holder. The diameter of the cleaning disk 21 is larger than the diameter of the housing 24. In this embodiment, the cleaning disk 21 is comprised of melamine foam 22 fixedly attached to a thin layer of material 23 for use in attaching the cleaning disk to the disk holder. In the embodiment shown, the material 23 is a nylon material that provides a plurality of hooks and/or loops to attach to the face of the disk holder 26 in a Velcro type attachment. Any appropriate material capable of providing hooks and/or loops to provide a Velcro type attachment to the disk holder may be used. The nylon is attached to the melamine foam using an appropriate adhesive, such as for example a polyurethane adhesive.

In another embodiment, the cleaning pad may be made of other materials, such as a sponge foam, or it may be comprised of a combination of materials such as a layer of melamine foam fixedly attached to a layer of sponge foam with the attachment material attached to the opposite side of the sponge foam from the melamine foam. The sponge foam may be attached to the layer of melamine foam using an adhesive. The relative thicknesses of the melamine foam and the sponge foam in this embodiment may be in any desired ratio, such as for example 1:10, 1:5, 1:1, 5:1 or 10:1. In one embodiment, the melamine foam is about 80% of the total thickness of the cleaning disk 21.

In another embodiment, the cleaning disk 21 may have a backing plate with attachment means for attaching the cleaning disk 21 to the disk holder 26. In this embodiment, the backing plate may be plastic with slots or snaps that attach to complementary attachment means on the disk holder 26. The plastic backing plate may be fixed to a layer of sponge foam, which is in turn attached on the opposite side from the backing plate to a layer of melamine foam which is used for cleaning. The relative thicknesses of the melamine foam and the sponge foam in this embodiment may be in any desired ratio, such as for example 1:10, 1:5, 1:1, 5:1 or 10:1. In one embodiment, the melamine foam is about 80% of the total thickness of the cleaning disk.

The cleaning disk 21 may be impregnated with a cleaning or deodorizing material, such as soap, that is released during use when the cleaning disk 21 is wet.

Figure 1:
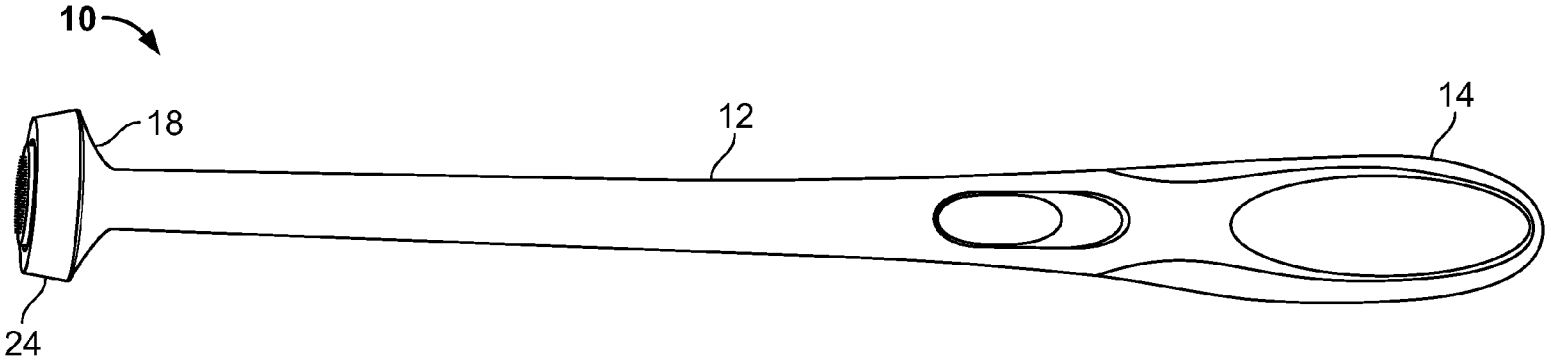
FIG. 1 shows a top view of one embodiment of the handle of the cleaning scrubber.
Figure 2:
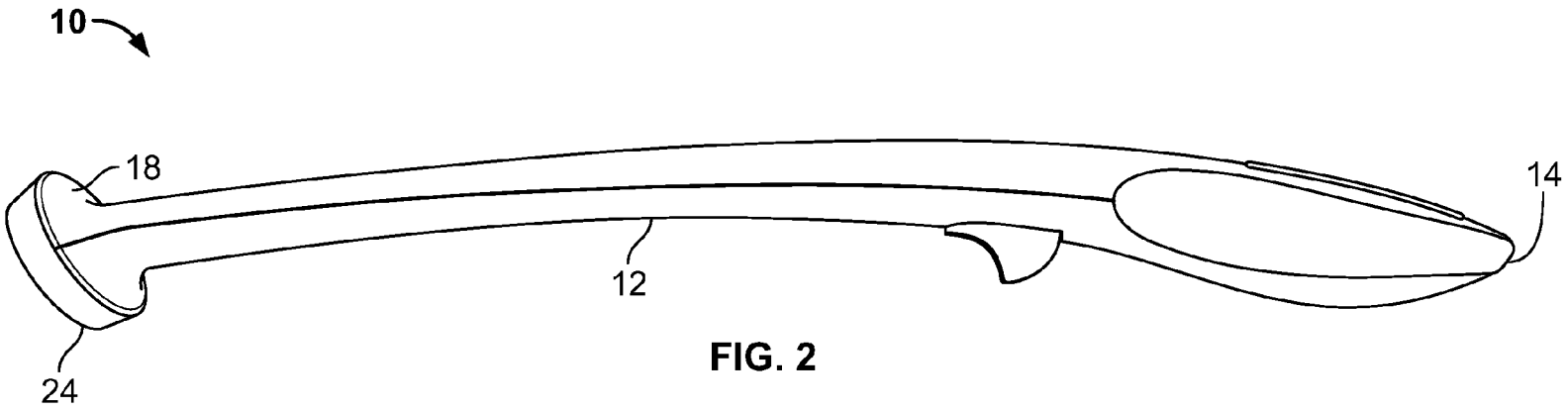
FIG. 2 shows a side view of one embodiment of the handle of the cleaning scrubber.
Figure 3:
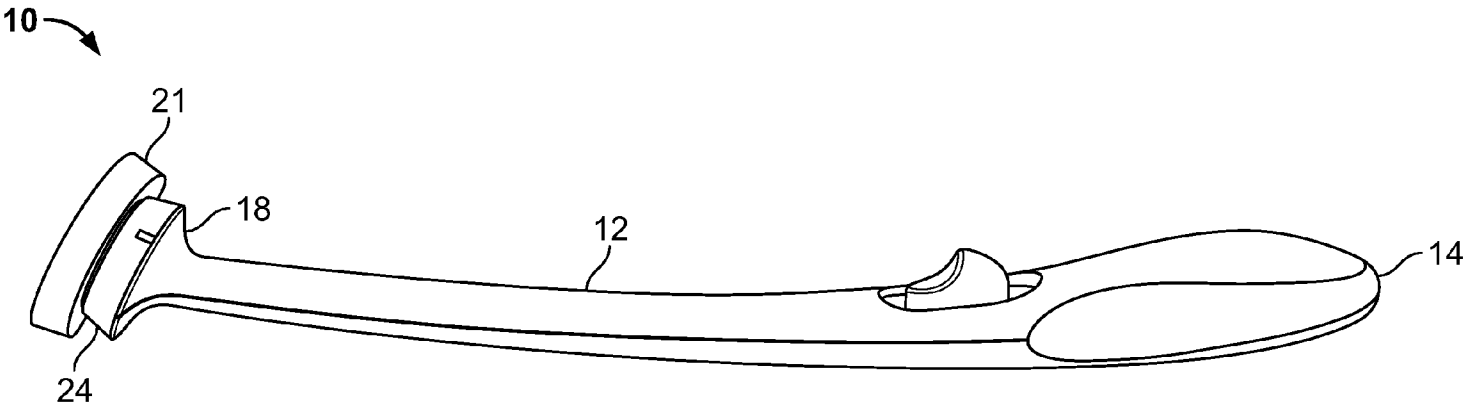
FIG. 3 shows a side view of one embodiment of the handle of the cleaning scrubber with a cleaning disk attached to the handle at the distal end.
Figure 4:
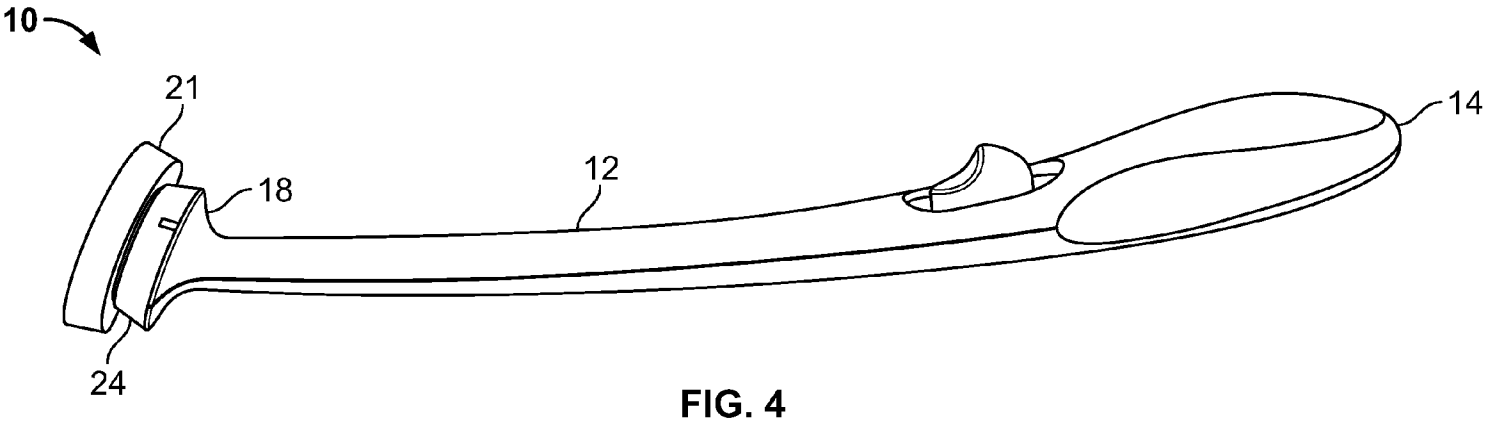
FIG. 4 shows a side view of one embodiment of the handle of the cleaning scrubber with a cleaning disk attached to the handle at the distal end.

FIGS. 3-5 show a cleaning disk 21 attached to the disk holder 26 at the end of the handle 12. As discussed above, in this embodiment, the cleaning disk is held in place by means of a Velcro type of attachment between the nylon material 23 on the cleaning disk 21 and the attachment surface of the disk holder 26.

Figure 7:
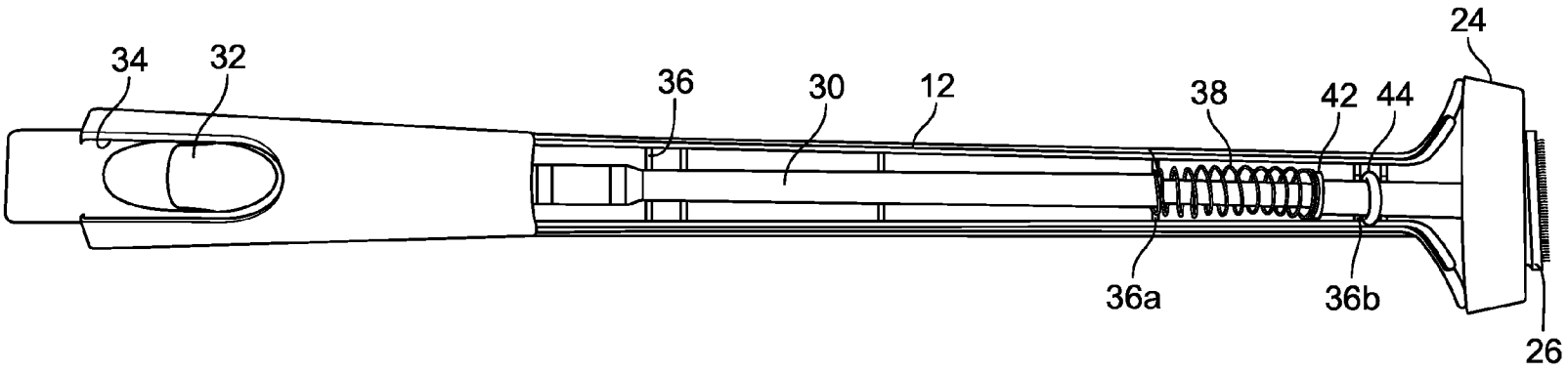
FIG. 7 is a side view showing one embodiment of a mechanism internal to the handle of the cleaning scrubber which provides means for removal of cleaning disks from the handle.
Figure 8:
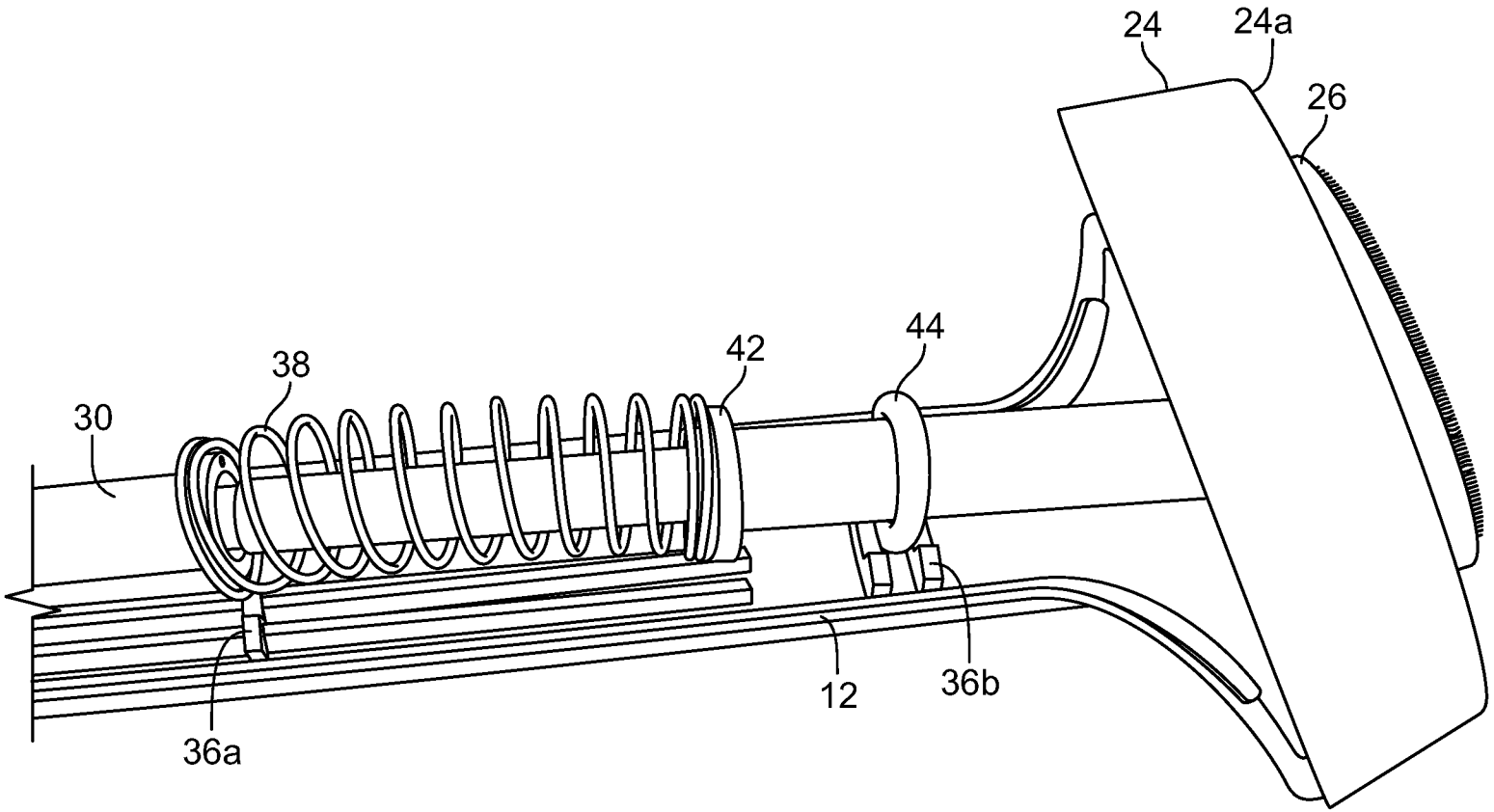
FIG. 8 is a side view of one embodiment of a biasing member internal to the handle of the cleaning scrubber.
Figure 9:
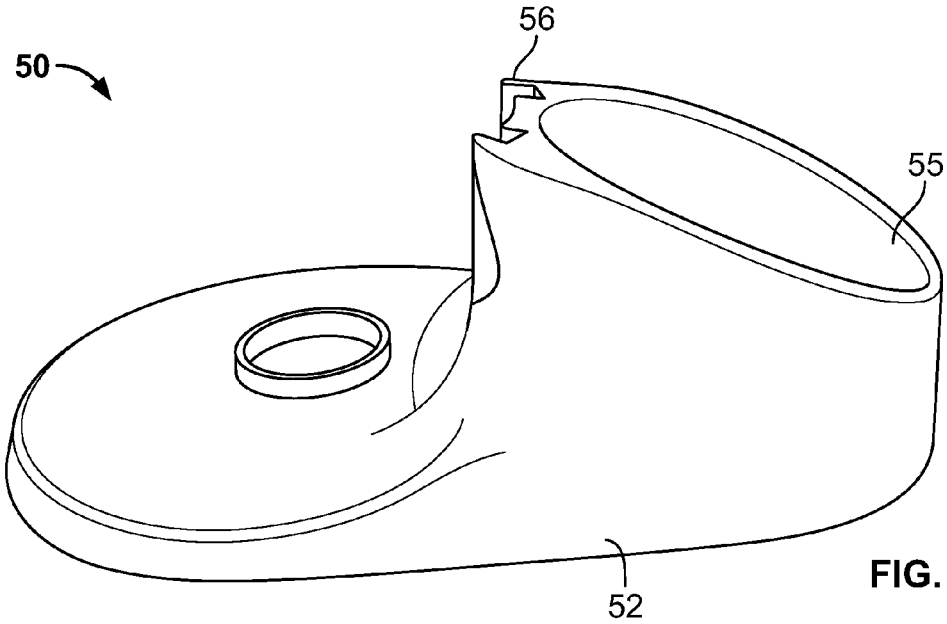
FIG. 9 is a side view of the base of one embodiment of a caddy for a cleaning scrubber.
Figure 10:
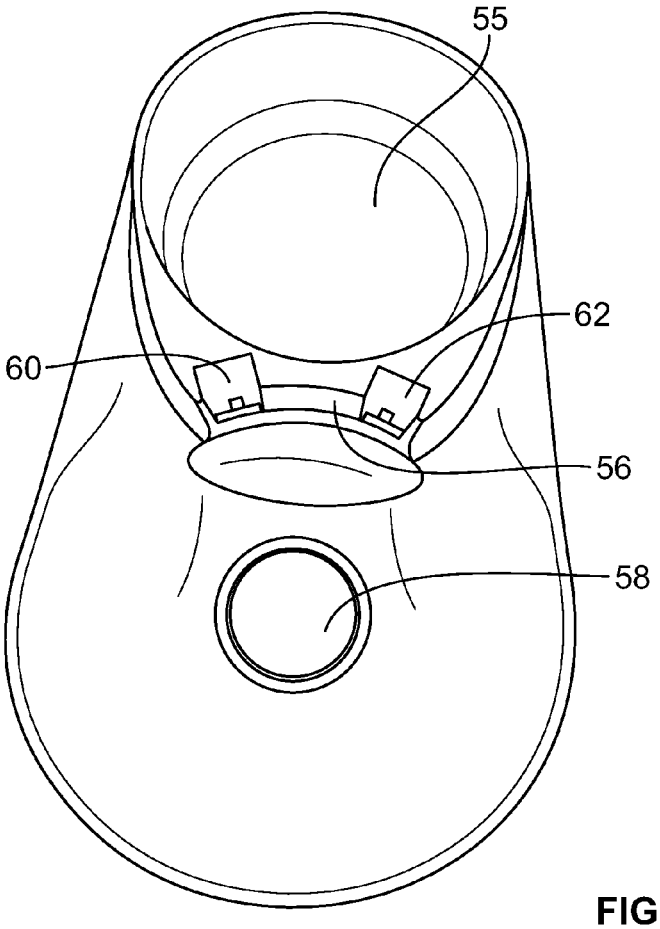
FIG. 10 is a top view of the base of one embodiment of a caddy for a cleaning scrubber.
Figure 11:
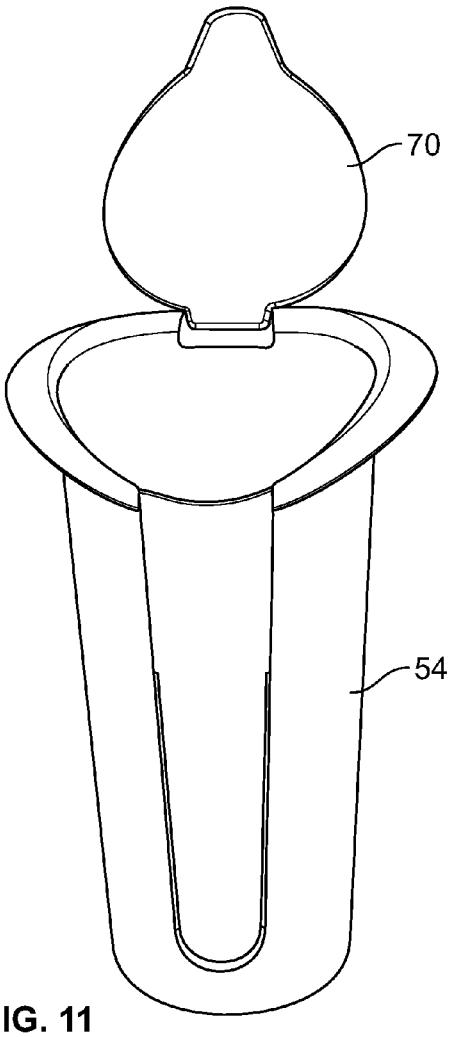
FIG. 11 is a side view of the upper portion of one embodiment of a caddy for a cleaning scrubber.
Figure 12:
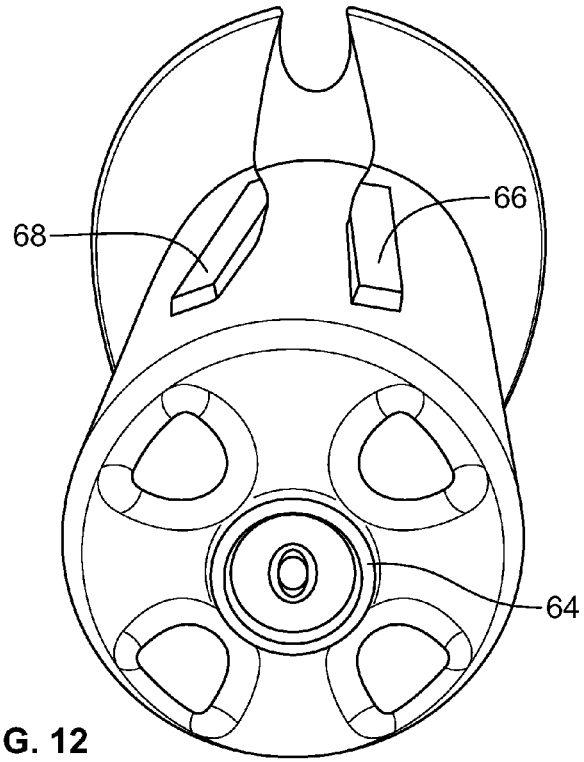
FIG. 12 is a top view of one embodiment of a caddy for a cleaning scrubber with the upper portion attached to the base.
Figure 13:
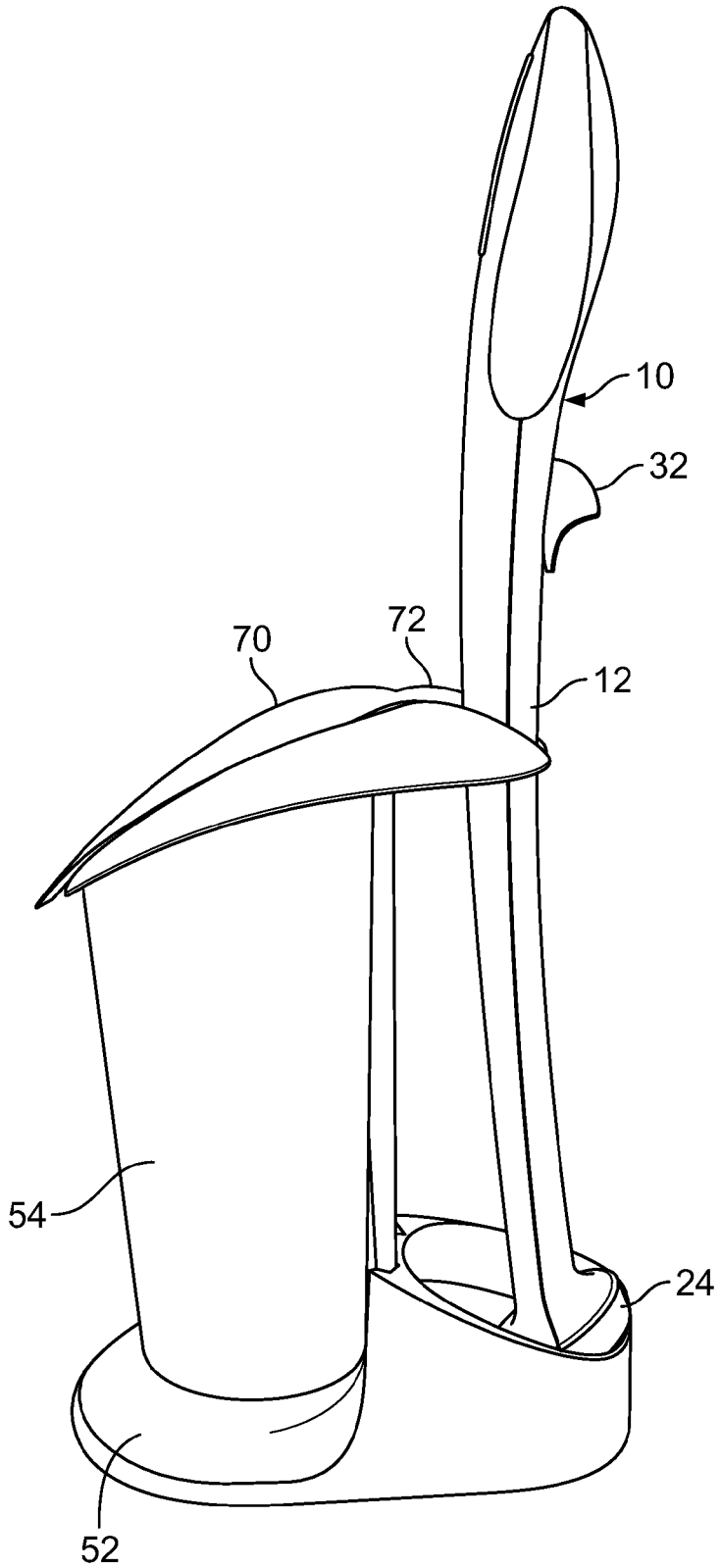
FIG. 13 is a side view of one embodiment of a caddy for a cleaning scrubber with a cleaning scrubber stored on the caddy.

In one embodiment, as shown in FIGS. 7 and 8, the cleaning scrubber 10 includes a mechanism to release the cleaning disk 21 (not shown) from the disk holder 26 without the need for the user to manually remove the cleaning disk 21 therefrom. In this embodiment, the disk holder 26 is attached to a distal end of a rod 30. The rod 30 extends within the handle 12 from the disk holder 26 to the proximal gripping end of the handle 12. At the gripping end of the handle 12, the rod 30 includes a trigger 32 which protrudes through a corresponding slot 34 in the handle 12. The rod 30 is disposed within the handle, and annular supports or guides 36 for the rod may be provided within the handle 12 to guide sliding movement of the rod 30 therethrough.

The trigger 32 is manually movable within the slot 34 between a first, distal, position (as shown in the figures), and a second proximal position. The rod 30 includes a biasing member 38 thereon, biasing the rod 30, and thus the trigger 32, from the second position toward the first position. In the illustrated embodiment, the biasing member 38 is a coil spring. However, as should be understood by those of ordinary skill in the pertinent art, the biasing member can take the form of any type of spring, or alternatively, any biasing member, capable of biasing the trigger 32 from the second position toward the first position as described herein.

As shown in FIG. 8, the proximal end of the spring 38 abuts against an annular support 36*a* of the handle 12, defining a stop surface for the proximal end of the spring 38, and the distal end of the spring 38 abuts against a laterally-extending annular projection 42 of the rod 30, defining a stop surface at the opposing distal end of the spring 38. Thus, when the trigger 32 is manually retracted from the first position toward the second position, the projection 42 moves toward the support 36*a*, and compresses the spring 38 therebetween. When the trigger 32 is released, the spring 38 rebounds to move the trigger 32 back into the first position. Accordingly, unless manually moved into the second position, the trigger 32 resides in the first position.

In the first position of the trigger 32, the disk holder 26 protrudes through the central hole of the housing 24. As the trigger 32 is normally in the first position, the disk holder 26 normally protrudes through the housing 24. When the trigger 32 is manually moved to the second position, the disk holder 26 is retracted, i.e., withdrawn, into the housing 24. The distal, i.e., exterior, surface 24*a* of the housing 24 defines a stop surface for a cleaning disk 21 attached to the disk holder 26. When the trigger 32 is manually moved from the first position toward the second position, thereby retracting the disk holder 26 into the housing 24, the distal surface 24*a* of the housing impedes movement of the cleaning disk 21 along with the movement of the disk holder 26. Thus, as the disk holder 26 retracts into the housing 24, the cleaning disk 21 is released from the disk holder 26. In the illustrated embodiment, the Velcro type attachment is disconnected and the cleaning disk 21 is released from the disk holder 26. Thereafter, when the trigger 32 is released, the disk holder 26 projects through the housing 24 once again, and another cleaning disk 26 may be attached thereto.

The rod 30 may also include a stabilizing member 44 slidably received therein. In the illustrated embodiment, the stabilizing member 44 is an O-ring slidably received on the rod 30. As shown best in FIG. 8, the O-ring 44 is located within an annular support 36*b* of the handle 12. The O-ring assists in stabilizing the sliding movement of the rod 30 therethrough and through the handle 12.

The caddy 50 for use with the cleaning scrubber 10 is shown in FIGS. 9-13. The caddy 50 is comprised of a base 52 and an upper portion 54. The base 52 includes a cup 55 sized to receive a cleaning disk 21. The base 52 also includes means 56 for attaching the upper portion 54 to the base 52. As shown best in FIG. 10, the attachment means 56 include a receiving part 58 and two slots 60, 62. The receiving part 58 is sized to hold a complementary part 64 on the upper 54 portion. The slots 60, 62 receive two tongs 66, 68 on the side of the upper portion 54. The tongs 66, 68 may include hooked end portions, which are received in the slots 60, 62 in the base 52 to hold the upper portion 54 on the base 52.

The upper portion 54 is hollow to hold spare cleaning disks. A cover 70 may be provided with a hinge for opening and closing the cover 70. The upper portion 54 may also include a slot 72 in the cover 70 to hold the cleaning scrubber 10 in place for storage.

In use, a fresh cleaning disk 21 may be inserted in the cup 55 in the base 52 with the attaching means facing upward. The disk holder 26 at the distal end of the handle 12 is pressed against the cleaning disk 21 to cause the cleaning disk 21 to become attached to the disk holder 26 at the end of the handle 12. The cleaning disk 21 is wetted and may then be used to clean a surface, such as the surface of a toilet bowl, a sink or a shower or bath tub. After the surface has been cleaned, the cleaning disk 21 may be disposed of by holding the end of the cleaning scrubber 10 over a trash basket and pulling the trigger 32, as described above, to release the cleaning disk 21.

As may be recognized by those of ordinary skill in the pertinent art based on the teachings herein, numerous changes and modifications can be made to the above-described and other embodiments of the present invention without departing from the scope of the invention as defined in the appended claims. Accordingly, this description of embodiments is to be taken in an illustrative, as opposed to a limiting sense.

What is claimed:

1. A cleaning brush, comprising:

a handle having a gripping portion at a proximate end and an end portion at a distal end;

a housing having a proximal end attached to the distal end of the handle and a distal end having an opening;

a rod extending through the interior of the housing and slidably movable between first and second positions, wherein the proximal end of the rod includes a trigger protruding through a slot in the housing and the distal end of the rod includes a cleaning disk holder, wherein the cleaning disk holder has first attachment means for attaching a cleaning disk;

a cleaning disk comprising a foam cleaning pad having a cleaning surface on a first side and second attachment means on the side opposite the cleaning surface wherein the second attachment means on the cleaning disk are complementary to the first attachment means on the cleaning disk holder to allow the cleaning disk to be removably attached to the cleaning disk holder;

wherein the trigger is movable from a first position wherein the cleaning disk holder at the distal end of the rod extends through the opening in the distal end of the housing and a second position wherein the cleaning disk holder is retracted within the housing to thereby cause the cleaning disk to disengage from the cleaning disk holder.

2. The cleaning brush of claim 1, wherein the cleaning disk is comprised of melamine foam.

3. The cleaning brush of claim 2, wherein the melamine foam is fixedly attached to a layer of sponge foam, and the second attachment means on the cleaning disk is fixedly attached to the side of the sponge foam opposite the melamine foam.

4. The cleaning brush of claim 1, wherein the complementary first and second attachment means is one of Velcro, an adhesive, a snap system or a slot system.

5. The cleaning brush of claim 1, wherein the cleaning disk comprises a backing plate fixedly attached to the foam cleaning pad opposite the cleaning face, wherein the attachment means are mounted on the backing plate.

6. The cleaning brush of claim 1, wherein the foam cleaning pad is impregnated with a soap or deodorizing material.

7. The cleaning brush of claim 1, further comprising a biasing member which biases the position of the trigger toward the first distal position.

8. The cleaning brush of claim 7, wherein the biasing member is a coil spring which abuts against a laterally extending annular projection on the rod.

* * * * *